US005597071A

United States Patent [19]

Sutherland

[11] Patent Number: 5,597,071

[45] Date of Patent: Jan. 28, 1997

[54] WRAP-AROUND CARRIER WITH CORNER BED RESTRAINTS

[75] Inventor: Robert L. Sutherland, Kennesaw, Ga.

[73] Assignee: Riverwood International Corporation, Atlanta, Ga.

[21] Appl. No.: 441,098

[22] Filed: May 15, 1995

[51] Int. Cl.[6] ..... B65D 75/00

[52] U.S. Cl. ..... 206/434; 206/435; 206/161; 206/147; 206/152

[58] Field of Search ..... 206/434, 435, 206/427, 139, 145, 147, 152, 153, 155, 161

[56] References Cited

U.S. PATENT DOCUMENTS

| | | | |
|---|---|---|---|
| 3,121,523 | 2/1964 | Hasselo | 206/155 X |
| 3,157,309 | 11/1964 | Chidsey, Jr. et al. | 206/155 |
| 3,167,214 | 1/1965 | Mahon | 206/155 |
| 3,258,190 | 6/1966 | Wood | 206/145 X |
| 3,269,531 | 8/1966 | Weiss | 206/427 |
| 3,373,867 | 3/1968 | Wood | 206/140 |
| 3,652,005 | 3/1972 | Morgese | 206/434 |
| 3,669,342 | 6/1972 | Funkhouser | 206/434 X |
| 3,679,121 | 7/1972 | Morgese | 206/140 X |
| 4,215,781 | 8/1980 | Humphries et al. | 206/434 |
| 5,297,673 | 3/1994 | Sutherland | 206/147 |

*Primary Examiner*—Paul T. Sewell
*Assistant Examiner*—Tara L. Laster

[57] ABSTRACT

A wrap-around carrier including upper and lower corner restraint panels for preventing outward movement of packaged articles. The partial end panels are locked in place by side panel locking flaps which extend between an adjacent end article and a connected side panel. Transversely extending fold lines in the corner restraint panels relieve carrier forming stresses.

12 Claims, 3 Drawing Sheets

WRAP-AROUND CARRIER WITH CORNER BED RESTRAINTS

FIELD OF THE INVENTION

This invention relates to wrap-around article carriers. More particularly, it relates to wrap-around carriers which include corner restraints for preventing outward movement of the packaged articles.

BACKGROUND OF THE INVENTION

Wrap-around carrier packages are formed by wrapping a carrier blank around a group of articles and securing the ends of the blank together. The articles are held in place by the tightly wrapped carrier and also, typically, by heel cutouts through which the bottom portions of the articles extend. The bite between the edges of the cutout apertures and the articles helps maintain the articles in place. Additional steps have also been taken to prevent outward movement of the articles. For example, wrap-around carriers for beverage cans have been provided with straps extending from the top or bottom panels, or from both, to the side panels to act as corner restraints against can movement.

The typical shape of a beverage can consists of a cylindrical body with inwardly tapered top and bottom portions leading to the top and bottom of the can. In the past the tapered portions have been only relatively mildly sloped, leading to relatively large can ends. A wrap-around carrier formed about such cans results in a package of relatively uniform shape, which facilitates the design and application of the wrapper. The generally rectangular shape of the package allows the top, side and bottom panels to readily conform to the slight angles at the upper and lower portions of the side panels of the carrier and also allows the corner restraint straps to readily conform to the upper and lower portions of the end cans.

There is now a growing trend toward the use of beverage cans having smaller diameter tops. This creates a greater taper between the body of the can and the top, making it very difficult to use the wrap-around carriers previously employed. The smaller diameter can tops require the width of the top panel to be reduced, which in turn requires the height of the side panels to be increased to compensate for the greater distance the side panels must extend over the upper tapered portion of the cans. These differences result in excessive stress on the corner restraints, which tend to crack at various points during carrier formation. Not only is the resulting appearance unsightly, but the corner straps may not be capable of reliably restraining the end cans against outward movement without danger of breaking or rupturing.

It is therefore an object of the invention to provide a wrap-around carrier capable of conforming to the shape of beverage cans or other articles with relatively small tops and steep tapers so as to form a tightly wrapped carrier of pleasing appearance. A further object is to provide a carrier of this type which is capable of restraining the articles against outward movement without danger of the corner restraint straps cracking or breaking.

BRIEF SUMMARY OF THE INVENTION

The invention is embodied in a package formed of a carrier of basic wrap-around design. Upper and lower corner restraint panels, which are connected to the top panel and the bottom panel flaps, respectively, contact the upper and lower portions of adjacent articles in the package. Means for locking the upper and lower corner restraint panels in place are connected to the side panels, and a transversely extending fold line is provided in each corner restraint panel. This arrangement permits corner restraint panels to be employed in wrap-around carriers designed to receive steeply tapered articles without putting the integrity and appearance of the corner restraints at risk from carrier forming stresses.

Preferably, the corner restraint locking means comprises a side panel locking flap foldably connected to opposite ends of the side panels and to the upper and lower corner restraint panels. Each side panel locking flap extends between, and is in contact with, adjacent end articles and the associated side panel. Also, each side panel preferably includes score lines substantially parallel to and spaced from the fold lines connecting the side panel to the top and bottom panels to enable the side panels to better follow the contour of the upper and lower portions of adjacent articles.

The significant features of the invention are brought out in more detail below in connection with the preferred embodiments, wherein the above and other aspects of the invention, as well as other benefits, will readily become apparent.

DETAILED DESCRIPTION OF THE PREFERRED EMBODIMENT

Figure 1:
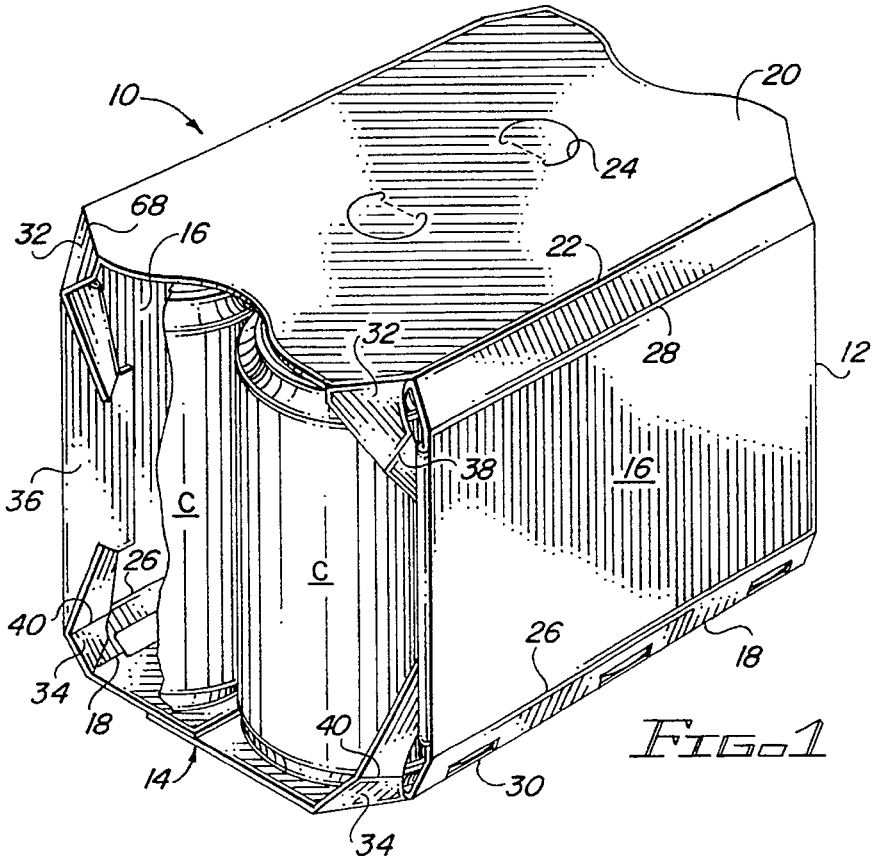
FIG. 1 is a pictorial view of the wrap-around carrier of the invention illustrated as part of a package containing six beverage cans.
Figure 2:
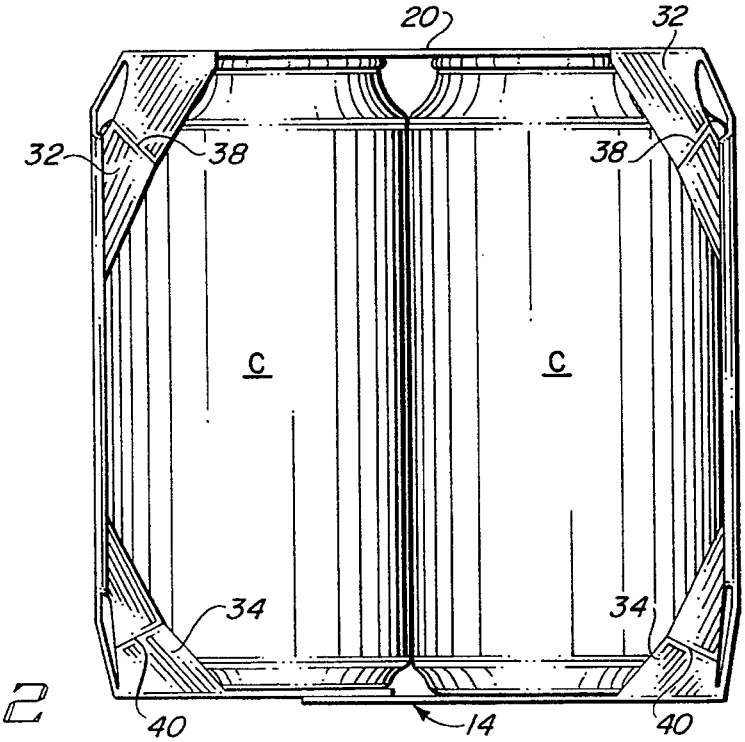
FIG. 2 is an end view of the carrier of FIG. 1.

Referring to FIGS. 1 and 2, a package 10 is comprised of a wrap-around carrier 12 containing six abutting beverage cans C, arranged in two rows of three cans each, supported on bottom panel 14. Side panels 16 are connected to the bottom panel 14 along fold lines 18 and to top panel 20 along fold lines 22. The top panel includes finger holes 24 to facilitate lifting the carrier. The lower portion of the side panels includes score line 26 and the upper portion includes score line 28, both of which are substantially parallel to the fold lines 18 and 22, to better permit the carrier wrapper to be pulled tightly about the tapered portions of the cans. Also, cutouts 30 are provided in the lower portion of the side panels to better grip the bottom edges of the cans. The carrier additionally includes upper and lower corner gusset restraints 32 and 34, respectively, which contact and resist outward movement of adjacent cans. The upper and lower corner gusset restraints 32 and 34 are connected at one end to the top and bottom panels, respectively, and at the other end to side panel locking flaps 36, the function of which is explained in more detail below. In addition, the upper and lower gusset restraints 32 and 34 include angle forming scores 38 and 40, respectively.

Figure 3:
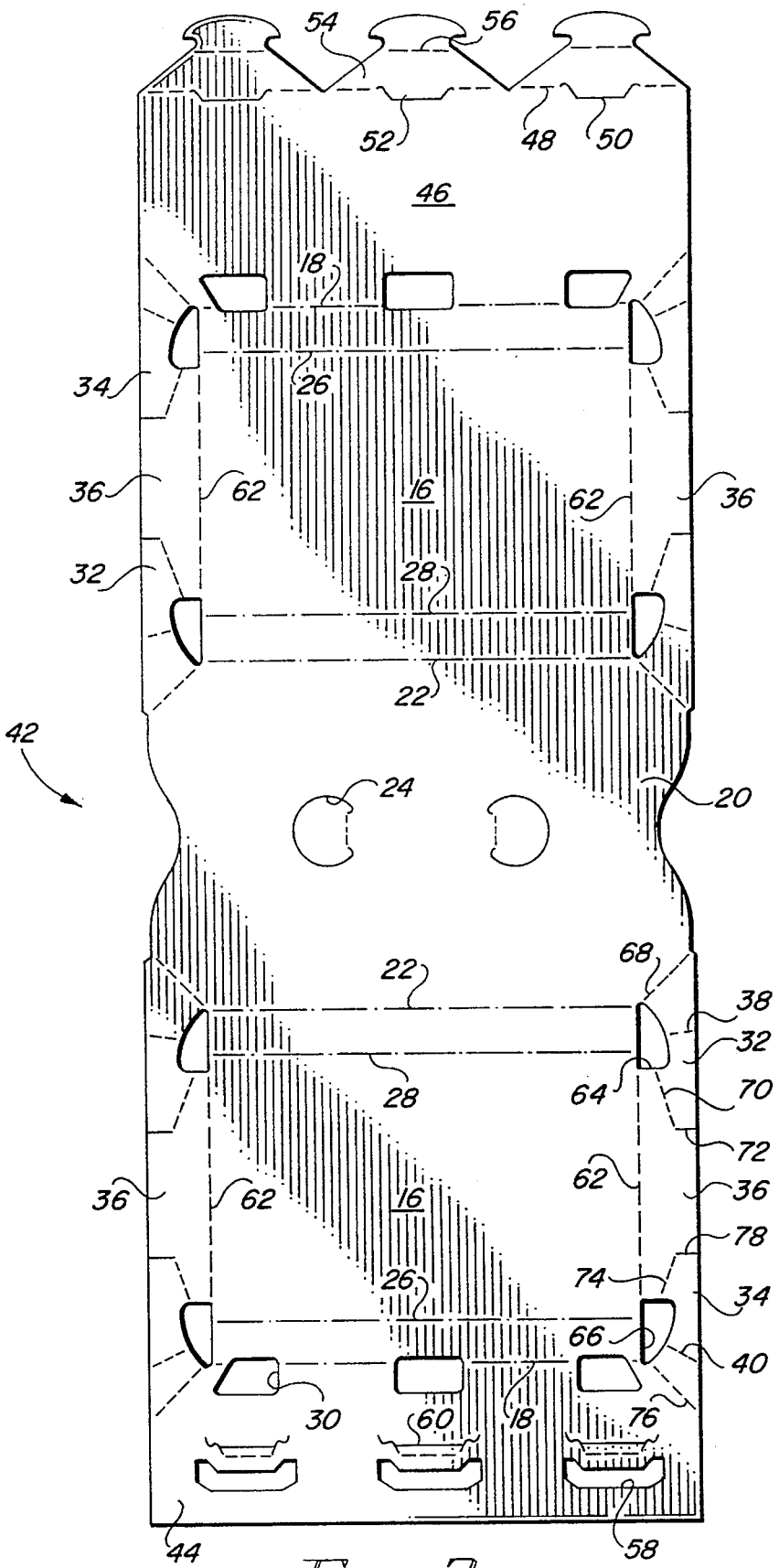
FIG. 3 is a plan view of a blank for forming the carrier of FIG. 1.

Referring to FIG. 3, wherein like reference numerals to those used in FIGS. 1 and 2 denote like elements, a blank 42 capable of being fabricated into the carrier of FIG. 1 includes a centrally located top panel section 20 connected to adjacent side panel sections 16 by the fold lines 22. One of the side panel sections 16 is connected by fold line 18 to bottom panel flap 44 and the other side panel section is connected by fold line 18 to bottom panel flap 46. The bottom panel flap 46, which partially overlaps the bottom panel flap 44 in a carrier formed from the blank and is referred to as the outer bottom panel flap, includes a fold line 48 which is interrupted by slits 50 forming primary male locking tabs 52. Secondary male locking tabs 54 are connected along fold line 48 and include an intermediate fold line 56. The bottom panel flap 44, which is the inner bottom panel flap, incorporates cutouts including primary female locking edges 58 adapted to engage the primary male locking tabs 52. The flap 44 also includes slits 60 adapted to receive the outer portions of the secondary locking tabs 54. Although these various locking elements are illustrated to demonstrate a typical bottom panel locking arrangement suitable for use with the carrier of the invention, it should be understood that any desired effective form of bottom panel locking means may be employed.

Still referring to FIG. 3, the side panel locking flaps 36 are connected to the side panel sections 16 by fold lines 62, which terminate at upper and lower cutouts 64 and 66, respectively. The upper gusset restraints 32 are connected along angled fold lines 68 to the corner areas of top panel section 20 and along angled fold lines 70 to associated side panel locking flaps 40. Each fold line 70 extends from a cutout 64 to a short slit 72, which in turn extends out to the edge of the locking flap 36 along a path substantially parallel to the fold lines 22. The lower gusset restraints 34 are connected to associated side panel locking flaps 36 along angled fold lines 74 and to the bottom panel flaps 44 along angled fold lines 76. Each fold line 74 extends from a cutout 66 to a short slit 78, which in turn is a continuation of an outer edge of the lower gusset restraints 32.

The score lines 28 extend between the cutouts 64 and are spaced from the fold lines 22 a distance corresponding to the sloped upper tapered portion of the cans to be packaged. Similarly, the score lines 26 extend between the cutouts 66 and are spaced from the fold lines 18 a distance corresponding to the sloped lower tapered portion of the cans. The fold lines 38 in the upper gusset restraints 32 extend from the cutouts 64 to the outer edge of the gusset at a slight upward angle with respect to the score lines 22 and 28. The fold lines 40 in the lower gusset restraints 34 extend from the cutouts 66 to the outer edge of the gusset at a slight downward angle with respect to the score lines 18 and 26.

Figure 4:
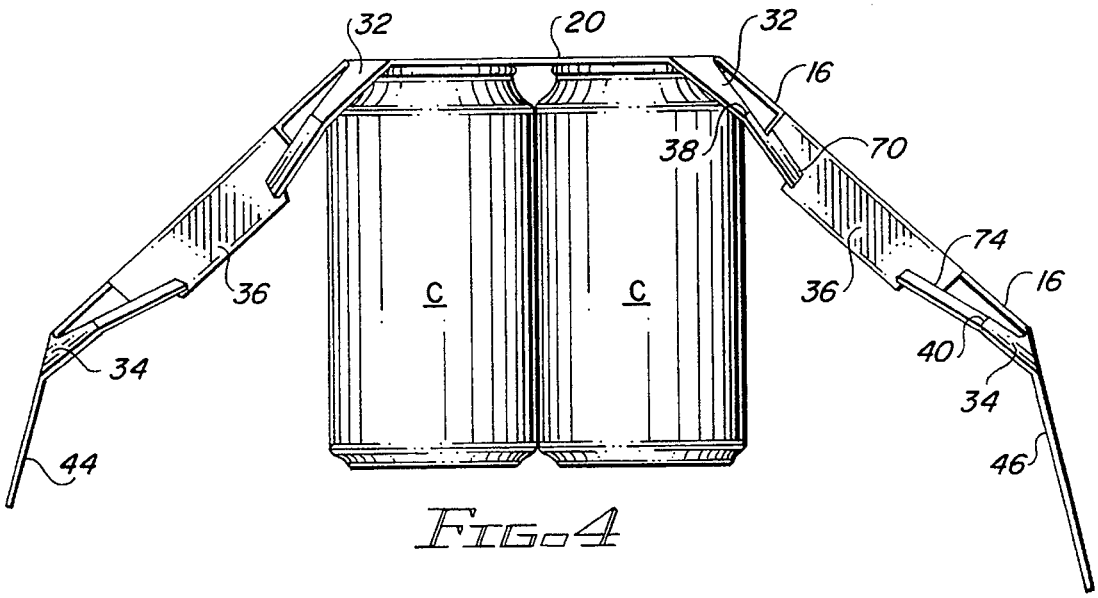
FIG. 4 is an end view of an initial stage of the carrier blank as it is being wrapped around a group of cans during formation of a carrier.

To form the package of FIG. 1, the blank 42 is placed on top of a group of six cans and the side panel sections 16 are folded down about the fold lines 22. The bottom panel flaps 44 and 46 are then folded in along their fold lines 18 while at the same time pivoting the side panel locking flaps 36 in about the fold lines 62. Inward movement of the side panel locking flaps moves the fold lines 70 and 74 inwardly, which pulls the upper and lower gusset restraint panels or straps 32 and 34 inwardly. This action folds the upper gusset restraints 32 down about the fold lines 68 and the lower gusset restraints 34 up about the fold lines 76. FIG. 4 illustrates the carrier at a representative point during this initial stage of fabrication.

Figure 5:
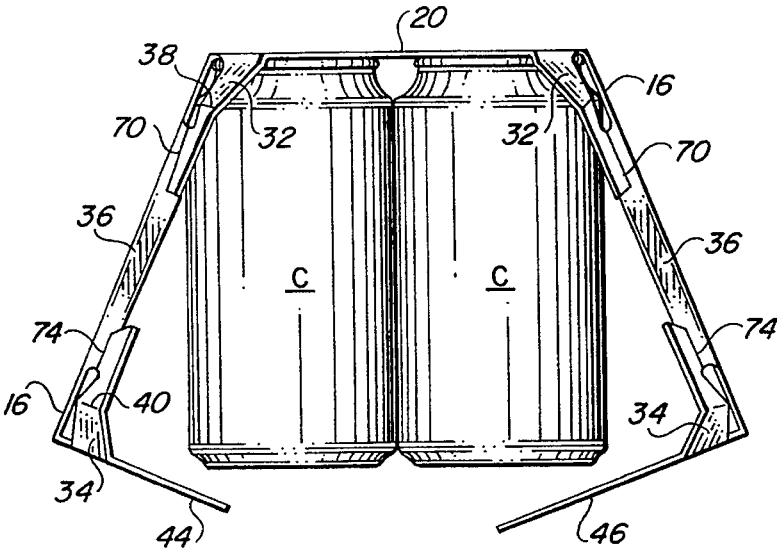
FIG. 5 is an end view similar to that of FIG. 4, but showing the carrier in a later stage of formation.

As the bottom panel flaps are folded about the fold lines 18, the side panel locking flaps 36 move toward their final position, in which they lie substantially flat against the connected side panel. The configuration of the blank in FIG. 5 illustrates the blank just prior to the bottom panel flaps reaching their final overlapping position. At this point the upper gusset restraint panels 32 have been formed to fit around adjacent outer upper portions of the cans when in their final position. The outer portions of the side panel locking flaps 36 which extend beyond the ends of the fold lines 70 and 74 are located so as to be pinched between the adjacent can and the adjacent side panel, thereby locking the side panel locking flaps in place. This arrangement is further illustrated in FIG. 1 where the can has been cut away to reveal the locking panel behind it. Because the side panel locking flaps 36 are pinched between the side panels and the adjacent cans, the upper and lower gusset restraint panels are also locked in place. While the width of the gusset panel segments is a matter of design preference, they must be wide enough to allow a significant area of the folded gusset panel to engage the bottom of a can without interfering with the locking of the bottom panel flaps.

While the various folding steps described can be done by hand it is contemplated that they would be carried out in a packaging machine as the cans and blank are continuously moving through the machine. Neither the packaging machine nor the folding elements of the machine have been shown since the various mechanical movements required in order to fold the panels of a carrier into place are well within the scope of one skilled in the packaging machine art.

Although the details of locking the bottom panel flaps together have not been illustrated since the particular locking mechanism employed does not form part of the invention, it will be understood by those familiar with the locking elements shown that the locking tabs 54 are first folded back about the fold lines 48 and the primary male locking tabs 52 are then engaged beneath the primary female locking edges 58 in bottom panel flap 44. The outer portions of the secondary male locking tabs 54 are then inserted through the slits 60 to complete the mechanical locking action. The folding of the bottom panel flaps also causes the lower gusset restraint panels 34 to fit around adjacent outer lower portions of the cans.

As the upper and lower gusset restraints are formed during application of the carrier, the intermediate score lines 38 and 40 allow the gusset panels to flex or fold in the area where it has been found to be most vulnerable to cracking or rupture. This relieves the extra stress placed on the gussets as a result of the greater distance they have to span in a carrier designed to accommodate cans with smaller tops and steep tapered portions. It also allows the gusset panels to be of sufficient depth to allow them to engage sufficiently large areas of the end cans in order to act as a stop against outward movement. In addition, the score lines 26 and 28 in the side panels permit the side panels to flex in about the tapered portions of the cans to prevent unsightly and potentially structurally damaging bowing of the side panels from occurring. As a result, the carrier fits tightly about the cans, both at the sides and ends, while remaining smooth and taut in appearance.

Although the carrier has been described in connection with the packaging of beverage cans, it is clear that the invention may be utilized in connection with the packaging of other types of articles as well. It will be appreciated that the articles may instead be inverted and placed into position on the blank prior to folding of the blank instead of placing the blank on top of upright articles as described. It should also be appreciated that the thickness of the blank has been exaggerated in the drawing for the purpose of illustration, and that the material of the blank, preferably paperboard, would actually be substantially thinner than shown.

It should now be apparent that the invention enables the use of corner gusset restraints with a wrap-around carrier having a relatively narrow top panel by providing stress relief fold lines in the corner gussets and locking them in place by means of the described locking panels. An extremely tight fit is further enhanced by providing score lines in the side panels near the top and bottom panels to enable the side panels to better follow the inward taper of the upper and lower portions of the cans or other articles.

It will be understood that the invention is not limited to all the specific details described in connection with the preferred embodiment and that changes to certain features of the preferred embodiment which do not alter the overall basic function and concept of the invention may be made without departing from the spirit and scope of the invention defined in the appended claims.

What is claimed is:

1. A package comprised of a wrap-around carrier containing two rows of adjacent articles having upper and lower portions, comprising:

opposite side panels, each side panel being connected to a top panel and to a bottom panel flap along fold lines, the bottom panel flaps being connected to each other to form a bottom panel;

the top panel, each bottom panel flap and each side panel having opposite end edges;

two upper corner restraint panels connected to each end edge of the top panel and a lower corner restraint panel connected to each end edge of each bottom panel flap, the upper and lower corner restraint panels contacting the upper and lower portions, respectively, of adjacent articles in the package;

means for locking the upper and lower corner restraint panels in place, said means being comprised of a side panel locking flap connected to each end edge of the side panels along a fold line, each side panel locking flap also being connected to associated upper and lower corner restraint panels along fold lines, each side panel locking flap extending between, and being in contact with, an associated side panel and an article adjacent thereto; and a fold line in each of the upper and lower corner restraint panels extending transversely thereof to relieve carrier forming stresses;

the upper corner restraint panels being connected to the top panel along angled fold lines which form an obtuse angle with the fold line connecting the top panel to an associated side panel, the top panel having a length between angled fold lines greater than the length of the fold line connecting the top panel to said associated side panel.

2. A package as defined in claim 1, wherein the lower restraint panels are connected to the bottom panel flaps along angled fold lines which form an obtuse angle with the fold line connecting the bottom panel to an associated side panel, the bottom panel having a length between angled fold lines greater than the length of the fold line connecting the bottom panel to said associated side panel.

3. A package as defined in claim 1, including a cutout between each upper corner restraint panel and an associated side panel section, the transversely extending fold line in each upper corner restraint panel extending to said cutout.

4. A package as defined in claim 2, including a cutout between each lower corner restraint panel and an associated side panel section, the transversely extending fold line in each lower corner restraint panel extending to said cutout.

5. A blank for forming a wrap-around carrier for packaging two rows of adjacent articles, comprising:

a sheet including a centrally located top panel section;

opposite side panel sections connected to the top panel section by fold lines;

a bottom panel flap connected to each of the side panel sections by a fold line;

the top panel section, the side panel sections and the bottom panel flaps having opposite end edges;

two upper corner restraint panels connected to each end edge of the top panel section and a lower corner restraint panel connected to each end edge of each bottom panel flap for contacting adjacent articles in a carrier formed from the blank;

a locking panel connected by fold line to each end edge of each side panel section, each locking panel also being connected by fold line to each associated upper corner restraint panel and each associated lower corner restraint panel, each side panel locking flap in a carrier formed from the blank extending between, and being in contact with, an associated side panel and an article adjacent thereto;

a fold line in each of the upper and lower corner restraint panels extending transversely thereof to relieve carrier forming stresses;

the upper corner restraint panels being connected to the top panel section along fold lines which form an obtuse angle with the fold line connecting the top panel section to an associated side panel section; and a cutout between each upper corner restraint panel and the associated side panel section, the transversely extending fold line in each upper corner restraint panel extending to said cutout.

6. A blank for forming a wrap-around carrier for packaging two rows of adjacent articles, comprising:

a sheet including a centrally located top panel section;

opposite side panel sections connected to the top panel section by fold lines;

a bottom panel flap connected to each of the side panel sections by a fold line;

the top panel section, the side panel sections and the bottom panel flaps having opposite end edges;

two upper corner restraint panels connected to each end edge of the top panel section and a lower corner restraint panel connected to each end edge of each bottom panel flap for contacting adjacent articles in a carrier formed from the blank;

a locking panel connected by fold line to each end edge of each side panel section, each locking panel also being connected by fold line to each associated upper corner restraint panel and each associated lower corner restraint panel, each side panel locking flap in a carrier formed from the blank extending between, and being in contact with, an associated side panel and an article adjacent thereto;

a fold line in each of the upper and lower corner restraint panels extending transversely thereof to relieve carrier forming stresses;

the lower corner restraint panels being connected to an associated bottom panel flap along fold lines which form an obtuse angle with the fold line connecting the side panel section to an associated bottom panel flap; and a cutout between each lower corner restraint panel and an associated side panel section, the transversely extending fold line in each lower corner restraint panel extending to said cutout.

7. A package comprised of a wrap-around carrier containing two rows of adjacent articles having upper and lower portions, comprising:

opposite side panels, each side panel being connected to a top panel and to a bottom panel flap along fold lines, the bottom panel flaps being connected to each other to form a bottom panel;

the top panel, each bottom panel flap and each side panel having opposite end edges;

two upper corner restraint panels connected to each end edge of the top panel and a lower corner restraint panel connected to each end edge of each bottom panel flap, the upper and lower corner restraint panels contacting the upper and lower portions, respectively, of adjacent articles in the package;

means for locking the upper and lower corner restraint panels in place, said means being comprised of a side panel locking flap connected to each end edge of the side panels along a fold line, each side panel locking flap also being connected to associated upper and lower corner restraint panels along fold lines, each side panel locking flap extending between, and being in contact with, an associated side panel and an article adjacent thereto; and a fold line in each of the upper and lower corner restraint panels extending transversely thereof to relieve carrier forming stresses;

the upper portion of each article including an inwardly tapered portion and each side panel including a score line substantially parallel to and spaced from the fold line connecting the side panel to the top panel, the score line enabling the side panel to better follow the contour of the upper portions of adjacent articles, the end edges of each side panel between said score line and the fold line connecting the side panel to the top panel being unconnected to the upper corner restraint panels.

8. A package comprised of a wrap-around carrier containing two rows of adjacent articles having upper and lower portions, comprising:

opposite side panels, each side panel being connected to a top panel and to a bottom panel flap along fold lines, the bottom panel flaps being connected to each other to form a bottom panel;

the top panel, each bottom panel flap and each side panel having opposite end edges;

two upper corner restraint panels connected to each end edge of the top panel and a lower corner restraint panel connected to each end edge of each bottom panel flap, the upper and lower corner restraint panels contacting the upper and lower portions, respectively, of adjacent articles in the package;

means for locking the upper and lower corner restraint panels in place, said means being comprised of a side panel locking flap connected to each end edge of the side panels along a fold line, each side panel locking flap also being connected to associated upper and lower corner restraint panels along fold lines, each side panel locking flap extending between, and being in contact with, an associated side panel and an article adjacent thereto; and a fold line in each of the upper and lower corner restraint panels extending transversely thereof to relieve carrier forming stresses;

the lower portion of each article including an inwardly tapered portion and each side panel including a score line substantially parallel to and spaced from the fold line connecting the side panel to an associated bottom panel flap, the score line enabling the side panel to better follow the contour of the lower portions of adjacent articles, the end edges of each side panel between said score line and the fold line connecting the side panel to an associated bottom panel flap being unconnected to the lower corner restraint panels.

9. A blank for forming a wrap-around carrier for packaging two rows of adjacent articles, comprising:

a sheet including a centrally located top panel section;

opposite side panel sections connected to the top panel section by fold lines;

a bottom panel flap connected to each of the side panel sections by a fold line;

the top panel section, the side panel sections and the bottom panel flaps having opposite end edges;

two upper corner restraint panels connected to each end edge of the top panel section and a lower corner restraint panel connected to each end edge of each bottom panel flap for contacting adjacent articles in a carrier formed from the blank;

a locking panel connected by fold line to each end edge of each side panel section, each locking panel also being connected by fold line to each associated upper corner restraint panel and each associated lower corner restraint panel, each side panel locking flap in a carrier formed from the blank extending between, and being in contact with, an associated side panel and an article adjacent thereto; and a fold line in each of the upper and lower corner restraint panels extending transversely thereof to relieve carrier forming stresses;

the upper corner restraint panels being connected to the top panel section along angled fold lines which form an obtuse angle with the fold line connecting the top panel section to an associated side panel section, the top panel section having a length between angled fold lines greater than the length of the fold line connecting the top panel section to said associated side panel section.

10. A blank for forming a wrap-around carrier for packaging two rows of adjacent articles, comprising:

a sheet including a centrally located top panel section;

opposite side panel sections connected to the top panel section by fold lines;

a bottom panel flap connected to each of the side panel sections by a fold line;

the top panel section, the side panel sections and the bottom panel flaps having opposite end edges;

two upper corner restraint panels connected to each end edge of the top panel section and a lower corner restraint panel connected to each end edge of each bottom panel flap for contacting adjacent articles in a carrier formed from the blank;

a locking panel connected by fold line to each end edge of each side panel section, each locking panel also being connected by fold line to each associated upper corner restraint panel and each associated lower corner restraint panel, each side panel locking flap in a carrier formed from the blank extending between, and being in contact with, an associated side panel and an article adjacent thereto; and a fold line in each of the upper and lower corner restraint panels extending transversely thereof to relieve carrier forming stresses;

the lower corner restraint panels being connected to an associated bottom panel flap along angled fold lines which form an obtuse angle with the fold line connecting said associated bottom panel flap to an associated bottom panel flap, said associated bottom panel flap having a length between angled fold lines greater than the length of the fold line connecting said bottom panel flap to said associated side panel section.

11. A blank for forming a wrap-around carrier for packaging two rows of adjacent articles, comprising:

a sheet including a centrally located top panel section;

opposite side panel sections connected to the top panel section by fold lines;

a bottom panel flap connected to each of the side panel sections by a fold line;

the top panel section, the side panel sections and the bottom panel flaps having opposite end edges;

two upper corner restraint panels connected to each end edge of the top panel section and a lower corner restraint panel connected to each end edge of each bottom panel flap for contacting adjacent articles in a carrier formed from the blank;

a locking panel connected by fold line to each end edge of each side panel section, each locking panel also being connected by fold line to each associated upper corner restraint panel and each associated lower corner restraint panel, each side panel locking flap in a carrier formed from the blank extending between, and being in contact with, an associated side panel and an article adjacent thereto; and a fold line in each of the upper and lower corner restraint panels extending transversely thereof to relieve carrier forming stresses;

each side panel section including a score line substantially parallel to and spaced from the fold line connecting the side panel section to the top panel section, the score line enabling the side panel of a carrier formed from the blank to better follow the contour of the upper portions of adjacent articles which are inwardly tapered, the end edges of each side panel between said score line and the fold line connecting the side panel section to the top panel section being unconnected to the upper corner restraint panels.

12. A blank for forming a wrap-around carrier for packaging two rows of adjacent articles, comprising:

a sheet including a centrally located top panel section;

opposite side panel sections connected to the top panel section by fold lines;

a bottom panel flap connected to each of the side panel sections by a fold line;

the top panel section, the side panel sections and the bottom panel flaps having opposite end edges;

two upper corner restraint panels connected to each end edge of the top panel section and a lower corner restraint panel connected to each end edge of each bottom panel flap for contacting adjacent articles in a carrier formed from the blank;

a locking panel connected by fold line to each end edge of each side panel section, each locking panel also being connected by fold line to each associated upper corner restraint panel and each associated lower corner restraint panel, each side panel locking flap in a carrier formed from the blank extending between, and being in contact with, an associated side panel and an article adjacent thereto; and a fold line in each of the upper and lower corner restraint panels extending transversely thereof to relieve carrier forming stresses;

each side panel section including a score line substantially parallel to and spaced from the fold line connecting the side panel section to an associated bottom panel flap, the score line enabling the side panel of a carrier formed from the blank to better follow the contour of the lower portions of adjacent articles which are inwardly tapered, the end edges of each side panel between said score line and the fold line connecting the side panel section to an associated bottom panel flap being unconnected to the lower corner restraint panels.

* * * * *